United States Patent [19]

de Palézieux et al.

[11] Patent Number: 4,498,529

[45] Date of Patent: Feb. 12, 1985

[54] HEAT EXCHANGER

[75] Inventors: Jacques de Palézieux, Hauterive; Georges F. Jobin, Cormondrèche, both of Switzerland

[73] Assignee: Runtal Holding Company S.A., Glarus, Switzerland

[21] Appl. No.: 317,492

[22] Filed: Nov. 2, 1981

[30] Foreign Application Priority Data

Nov. 20, 1980 [CH] Switzerland ..... 8586/80

[51] Int. Cl.[3] ..... F28F 1/40; F28F 9/00

[52] U.S. Cl. ..... 165/176; 228/173 F; 228/183; 29/157.3 R

[58] Field of Search ..... 29/157.3 R; 165/175, 165/173, 172, 176; 228/173 F, 173 C, 183; 219/93; 285/189; 336/58

[56] References Cited

U.S. PATENT DOCUMENTS

| | | | |
|---|---|---|---|
| 1,823,028 | 9/1931 | Caldwell | 228/173 F |
| 2,001,923 | 5/1935 | Robertson et al. | 165/175 |
| 2,194,272 | 3/1940 | Blu | 228/173 F |
| 3,508,606 | 4/1970 | Blanchard et al. | 165/176 |

FOREIGN PATENT DOCUMENTS

| | | | |
|---|---|---|---|
| 1013731 | 12/1965 | United Kingdom | 219/93 |

*Primary Examiner*—Michael Koczo
*Assistant Examiner*—John J. McGlew, Jr.
*Attorney, Agent, or Firm*—Watson, Cole, Grindle & Watson

[57] ABSTRACT

The heat exchanger according to the invention comprises extremely flat oval-shaped tubes (3) extending in a mutually parallel and spaced-apart relationship and are connected on their narrow side to manifold pipes (1,2) for forward and return flow. To ensure a sufficiently stable mechanical connection between the pipes and a satisfactory supply and discharge of the heating medium from the manifolds to the flat tubes as well as in the reverse direction, a trough (5) is formed by material removal in the manifold pipes (1*a*, 2*a*) thus creating a connection aperture (6) in the wall of the pipe. The flat tube (3*a*) is fitted into this trough (5) with its rim on the narrow side, to ensure a solid stable welded joint between the pipes. The flat tube (3*a*) is provided on its narrow side with a bore serving as a connection aperture (7), which comes to lie centrally against the connection aperture (6) in the manifold (1*a*, 2*a*). A trough in the flat tube and a bore in the manifold pipe or a respective trough in the manifold pipe and in the flat tube could be developed as alternatives.

4 Claims, 16 Drawing Figures

Fig. 1
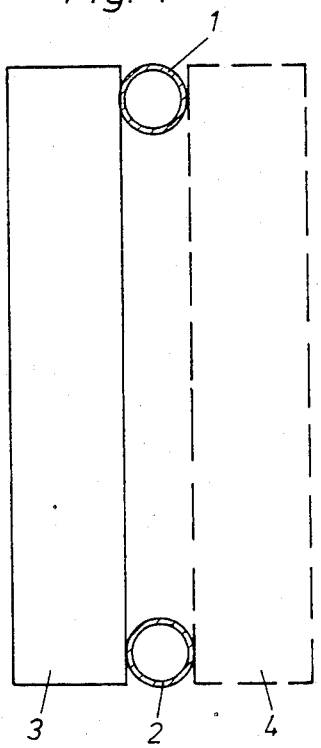
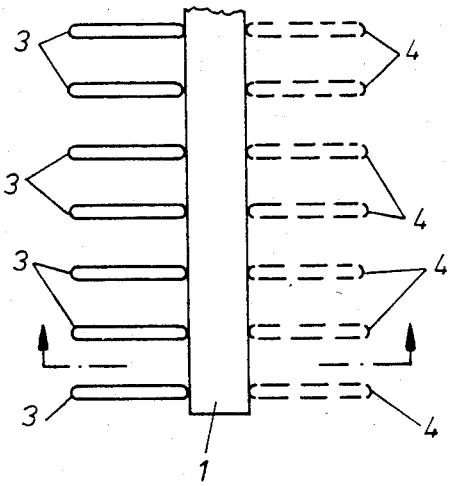
Fig. 2
Fig. 5
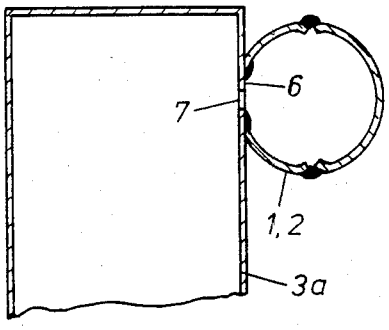
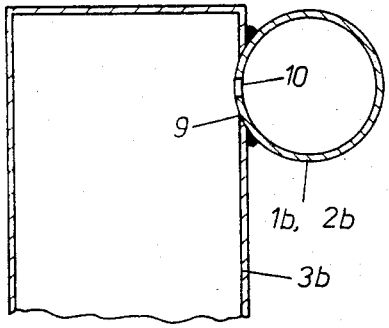
Fig. 8

HEAT EXCHANGER

BACKGROUND OF THE INVENTION

1. Field of the Invention

The invention relates to a heat exchanger having flat pipes arranged mutually parallel and spaced apart from one another, which are connected via connecting apertures formed on their narrow sides to corresponding connecting apertures of respective collector pipes for flow and re-flow by welding together the flat pipes with the collector pipes.

2. Description of the Prior Art

In the known heat exchangers of this type flat pipes are arranged such, that the pipes run parallel and at a distance from one another. In view of the technology applied in their production, customary flat pipes with relatively large volumes of water are used, because a sufficient width along the narrow side of the flat pipes for the formation of adequately dimensioned connecting apertures has to be provided. The width must be sufficient to obtain an acceptable stable connection of the flat pipes to the collector pipes by welding such as projection welding.

If the heat exchanger is used as a heating body in a central heating plant and hot water flows through the flat pipes at a high rate of flow resulting in a reduced thermal inertia of the heating body and thereby a better heat transmission, an improved utilization of the consumed energy can be accomplished. In order to achieve this effect in a heat exchanger of the kind described above, ultraflat oval shaped pipes are applied through which the water flows at a higher rate of flow. Ultraflat pipes may be defined as pipes which have a ratio of the surface area of the internal cross-section to the external circumference smaller than or equal to 2.5. The depth of such flat pipes is too small to allow the creation of sufficiently large connection apertures on their narrow sides which are necessary to ensure the flow of hot water from the collector pipes to the flat pipes or in the reverse direction. Moreover, the small depth of the flat pipes does not allow the creation of an adequately strong joint on their narrow sides by the customary welding methods to ensure the necessary stability of the heat exchanger.

The object of the invention is, therefore, to provide a heat exchanger of the kind described, that can be manufactured by known welding methods, to achieve a better utilization of consumed energy. To save energy, flat pipes with very small depths can be used. This objective is achieved by shaping a wall portion around each connection aperture of each flat pipe to correspond to a mating wall portion of the collector pipes.

BRIEF DESCRIPTION OF THE DRAWINGS

Various other objects, features and attendant advantages of the present invention will be more fully appreciated as the same becomes better understood from the following detailed description when considered in connection with the accompanying drawings, in which like reference characters designate like or corresponding parts through the several views and wherein:

FIG. 1 is a schematic side view of the heat exchanger;

FIG. 2 is a top plan view of the heat exchanger according to FIG. 1;

FIG. 5 shows the completed connection according to FIGS. 3 and 4 in cross-section through the manifold pipe;

FIG. 8 illustrates the completed connection according to FIGS. 6 and 7 in cross-section through the manifold pipe;

DETAILED DESCRIPTION OF THE PREFERRED EMBODIMENTS

Figure 3:
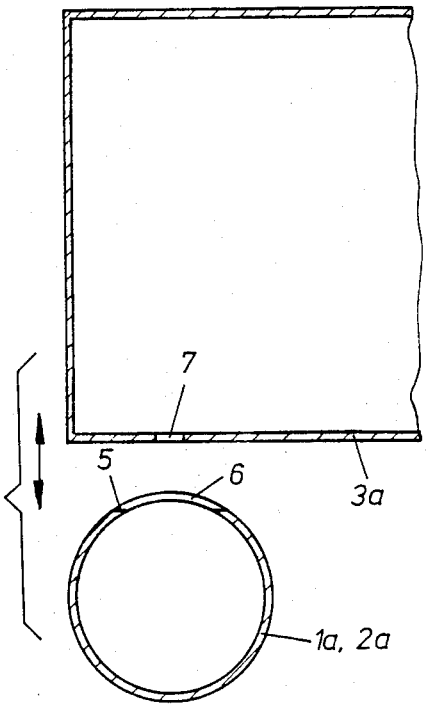
FIGS. 3 and 4 show the manifold pipe and the flat tube as a cut-out and on a larger scale in a spaced-apart condition, the manifold being shown in cross-section in FIG. 3 and in longitudinal section in FIG. 4 and being provided with a depression or trough for the connection.

The heat exchanger according to FIGS. 1 and 2 includes two manifolds 1 and 2 for forward and return flow and flat tubes 3 laterally connected to the manifolds 1,2, the flat tubes extending in a mutually parallel and equispaced relationship and being connected at their narrow sides to both of the manifolds 1 and 2. The heat exchanger with the flat tubes 3 illustrated on the left-hand side of continuous full lines shows a single-column type embodiment and the flat tubes 4 additionally connected on the right-hand side and shown in broken lines represent a two-column type embodiment.

In order to make it possible to manufacture the connections and joints not shown in FIGS. 1 and 2 between the manifolds and flat tubes with sufficient stability and reliability of the connection and with adequately large connection apertures when using extremely flat tubes, the manifolds or the flat tubes or both type of pipes must be prepared before making the connection by a mechanical treatment. In a first preferred embodiment according to FIGS. 3 and 4 each manifold pipe 1*a* , 2*a* is provided with a depression or trough 5 running through the pipe along a chord transverse or perpendicular to the pipe axis and disposed at the locus of attachment; the contour line of the trough corresponds to the cross-sectional profile of the flat tube 3 or at its narrow side, as shown in FIG. 4. The trough 5 is produced by milling with a profile cutter in such a way that, due to the removal of material, a break through or penetration results in the pipe wall representing a connection aperture 6 whereby the milled wall of pipe has the same profile as the trough 5, as shown in FIG. 4. The cross-section taken across the flat tube 3*a* shown in FIG. 4 also illustrates that this tube is extremely flat. The internal diameter of of this pipe is 3–5 mm for a tube or pipe with an externally measured height of approximately 70 mm and with a sheet gauge of from 1.25 mm to a maximum of 2.0 mm. With these flat tube dimensions the ratio of the surface area of the internal cross-section to the external circumference is smaller than or equal to 2.5 (cm.) Related to the length of the tube the ratio of the volume of water in the tube to the outer heating surface area of the pipe has the same value of 2.5 (cm). If the ratio is smaller, this means that in comparison with the larger cross-sectional areas of known heat exchangers, the heating surface related to the same volume of water is larger, therefore the heat transfer is better. Since less water or heat exchange fluid is contained in the flat tube and it flows at a higher rate of flow, the thermal inertia of the heat exchanger is lower than in heat exchangers not provided with extremely flat pipes.

The trough 5 necessary for a stable connection between the pipes could also be produced by pressing-in across the pipe into the pipe wall. In this case a connection aperture should be separately produced.

Figure 4:
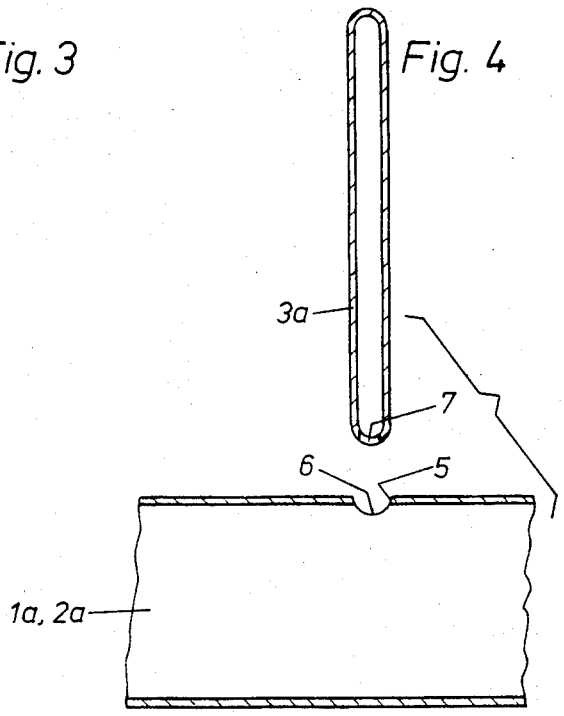

FIG. 5 illustrates on a reduced scale the finished connection between a manifold and a flat tube according to FIGS. 3 and 4, but wherein, as distinct from the illustration according to FIGS. 3 and 4, a manifold 1, 2 is shown which consists of two parts extending over the length of the pipe. In this method of connecting the flat tubes with the manifolds (which is one of the various possible methods of connection) the flat tube 3*a* is first welded from the inside outwards to one part of the manifold and thereafter both parts of the manifold are joined together by welding seams extending over the length of the pipe.

In the embodiment according to FIGS. 3 and 4, the flat tube 3*a* is provided with a single bore 7 representing the connection aperture or port which, when joining the flat pipe perpendicular to the manifold, becomes coaxial with the connection aperture 6 of the manifold pipe.

Figure 6:
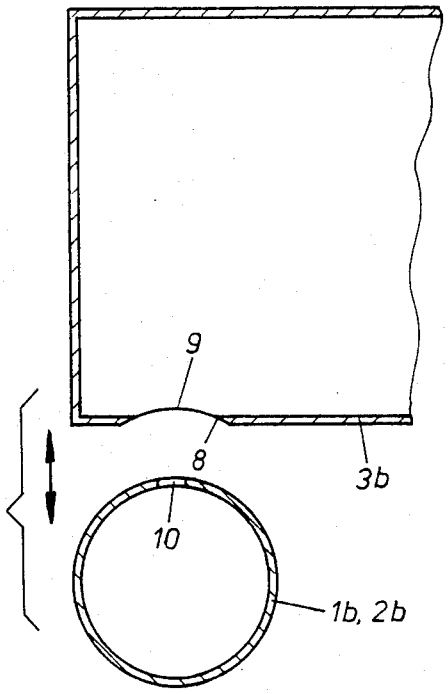
FIGS. 6 and 7 show the manifold pipe and the flat tube as a cut-out and on a larger scale in a spaced-apart relationship, the flat tube being shown in longitudinal section in FIG. 6 and in cross-section in FIG. 7 and being provided with a depression or trough for the connection.
Figure 7:
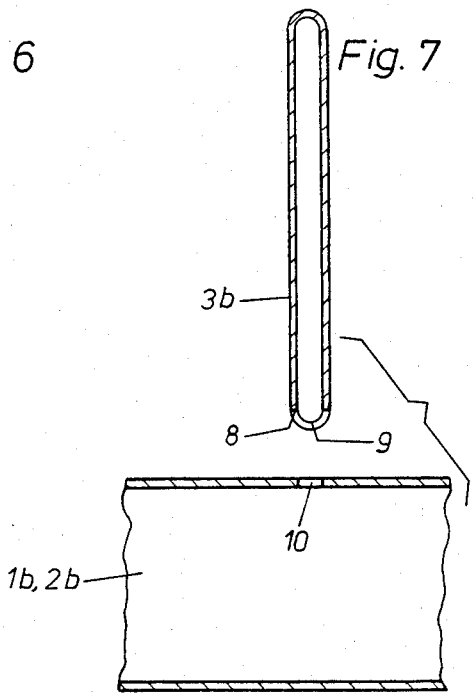

In the modified embodiment according to FIGS. 6 and 7, the flat pipe 3*b* is provided on its narrow side at each point of connection with a trough 8 which extends across or perpendicular to the longitudinal axis of the flat tube and the contour line of which in the axial direction of the pipe corresponds to the cross-sectional profile of the manifold pipe 1*b*, 2*b*. The trough 8 is also expediently milled out by a profile cutter in such a way that, as a result of the removal of material, a breakthrough or penetration 9 in the wall of the tube arises to represent the connection aperture. In this case the manifold pipe 1*b*, 2*b* is provided with a bore 10 which also represents a connection aperture. The completed connection of the pipes in the embodiment according to FIGS. 6 and 7 is illustrated in FIG. 8. Here, as another variant of the method of connection, the manifold and the flat tube are joined together by soldering, wherein the outer sides of the pipes are soldered to one another. The soldering is carried out around the connection aperture along the line of penetration of the pipes. A further known method of connecting the manifold pipe with the flat tube is the application of projection welding, which permits all jointing connections of the heat exchanger to be created simultaneously by the aid of a projection welding machine.

Figure 9:
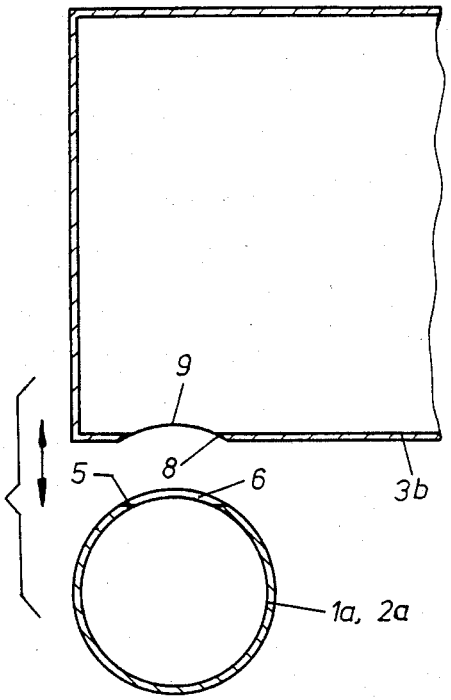
FIGS. 9 and 10 show the manifold pipe and the flat tube as a cut-out and on a larger scale in a spaced-apart relationship in cross-section (FIG. 9) and in longitudinal section (FIG. 10) through the manifold pipe, wherein the manifold pipe and the flat tube are each provided with a depression or trough for the connection.
Figure 10:
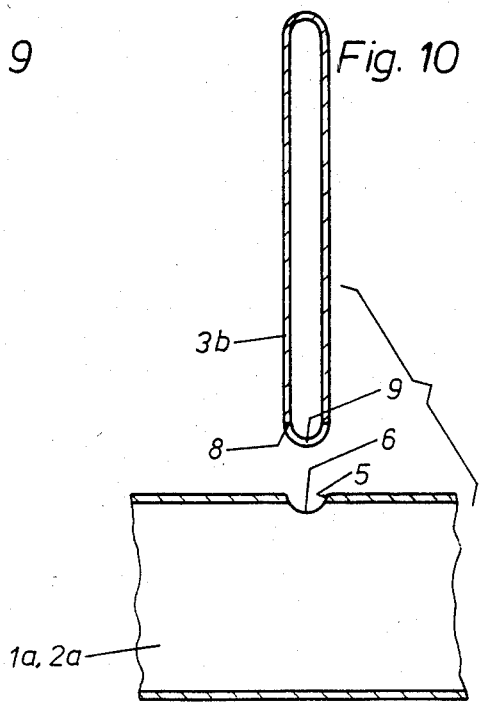

The diameter of the cylindrical bore representing the connection aperture 7 of the flat tube according to FIG. 3 or the connection aperture 10 of the manifold cannot be larger than the inside diameter of the flat tube which latter therefore sets the upper limit of the size of the connection aperture in all the embodiments according to FIGS. 3 to 8 and thus also of the volume of forward or return flow of the heating medium from the manifolds to the flat tubes or vice versa. If larger connection apertures of the interconnected pipes are required for a larger quantity of flow, then a trough 5 in the manifold 1*a*, 2*a* may be made by material removal as shown in FIGS. 9 and 10, similarly to the embodiment according to FIG. 3, as well as a trough 8 in the flat tube 3*b*, similarly to the embodiment according to FIG. 6, whereby the two pipes, with the slit-shaped connection apertures 6 and 9 come to lie against one another.

Figure 11:
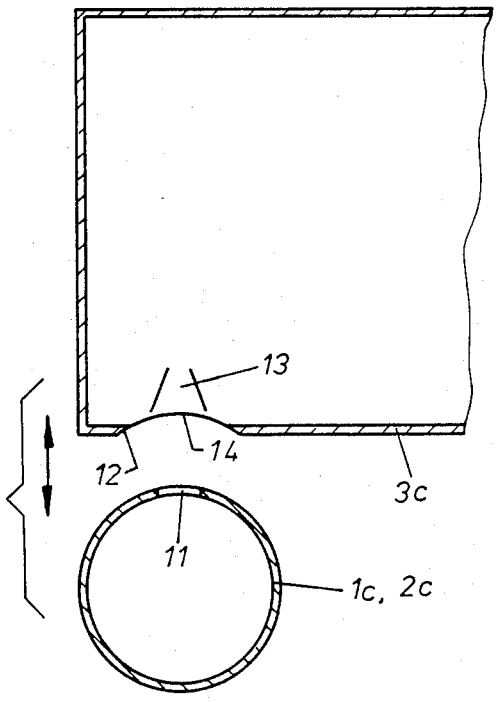
FIGS. 11 and 12 illustrate the manifold pipe and the flat tube as a cut-out and on a larger scale in a mutually spaced relationship, in longitudinal section in FIG. 11 and in cross-section in FIG. 12 through the flat tube which is provided with a transversely widened depression or trough for the connection.
Figure 12:
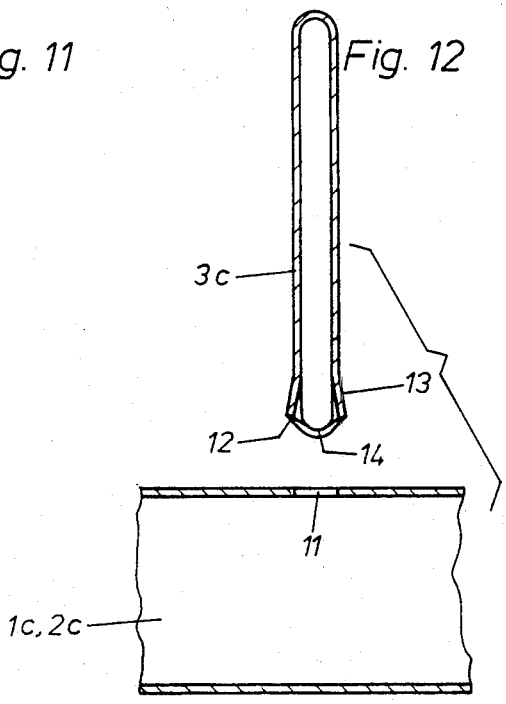

FIGS. 11 and 12 illustrate a further embodiment of the invention wherein the connection aperture in the manifold 1*c*, 2*c* is represented by a bore 11, the diameter of which is larger than the bore 10 according to FIGS. 6 and 7, the maximum size of which, as already has been pointed out, depends on the size of the inner diameter of the flat tube. Consequently the centrally positioned trough 12 created by removal of material in the flat tube 3*c* according to FIGS. 11 and 12 is widened by deforming the pipe wall in a direction transverse to the longitudinal axis of the flat tube. This widening 13 of the wall is clearly shown in FIG. 12 and makes it possible for the connection aperture 14 in the flat tube to overlap the enlarged connection aperture 11 of the manifold pipe.

Figure 13:
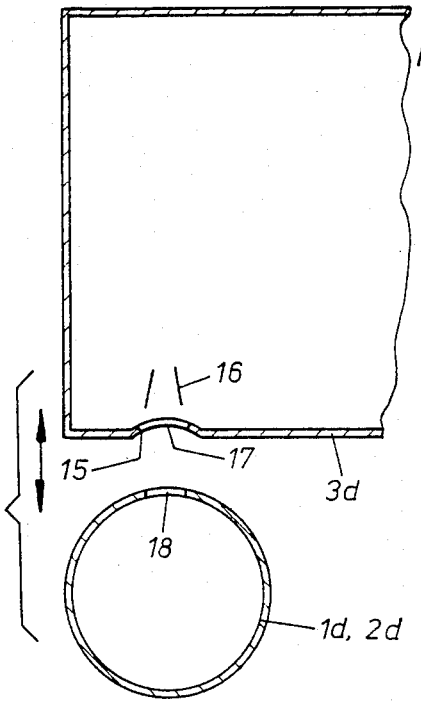
FIGS. 13 and 14 show the manifold and the flat tube as a cut-out and on a larger scale in a mutually spaced relation, the flat tube being in longitudinal section in FIG. 13 and in cross-section in FIG. 14 and being provided with a transversely widened bore.
Figure 14:
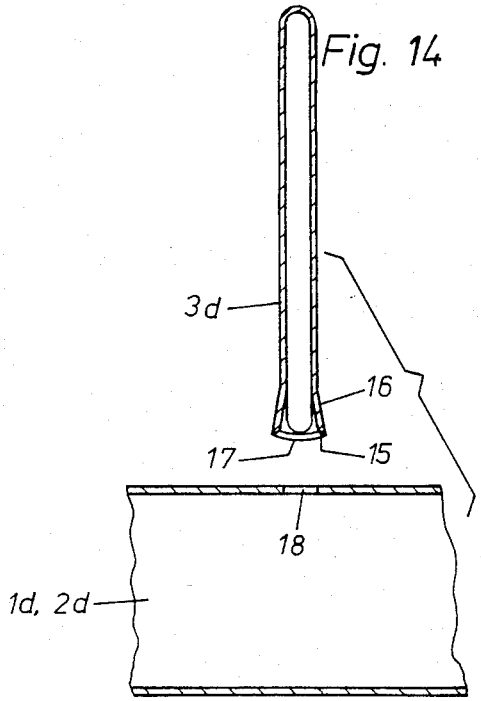

In a further embodiment according to FIGS. 13 and 14, a smaller trough 15 is created by a cylindrical bore in the flat tube 3*d*, and in which then a widening 16 is produced by deforming the wall transversely or perpendicular to the longitudinal axis of the tube to create a connection aperture 17. The manifold pipe 1*d*, 2*d*, is provided with a connection aperture 18 of approximately the same size but larger than e.g. the connection aperture 10 of the manifold pipe 1*b*, 2*b* according to FIGS. 6 and 7. The rim of the wall encircling the connection aperture 17 in the flat tube may, in view of the widening 16, be rigidly welded around the connection aperture 18 to the wall of the manifold pipe 1*d*, 2*d*.

Figure 15:
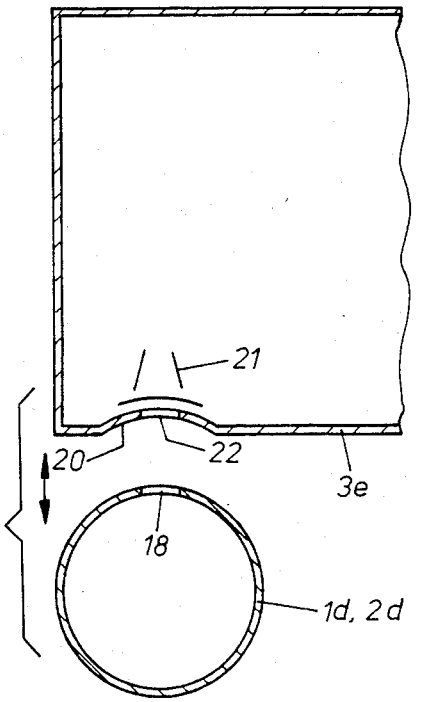
FIGS. 15 and 16 illustrate the manifold pipe and the flat tube in a mutually separate state, wherein the flat tube is provided with an inwardly pressed-in depression or trough and with a widened connection bore.
Figure 16:
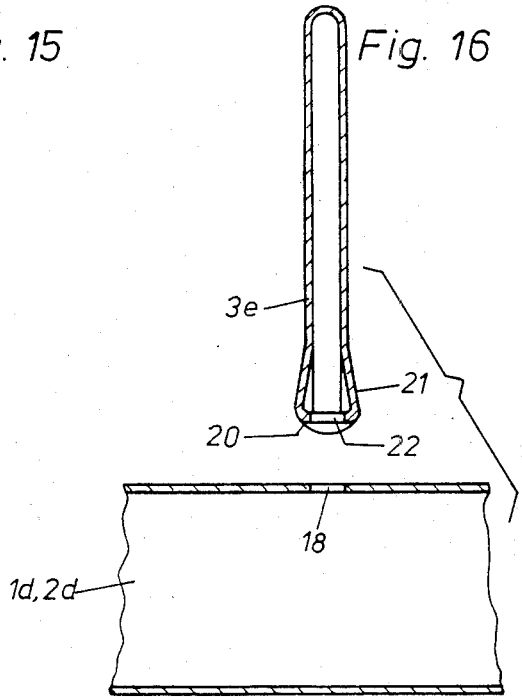

In a preferred embodiment of the invention according to FIGS. 15 and 16, a trough 20 is pressed into the flat tube 3*e* on its narrow side. A bore 22 in the center of trough 20 forms the connection aperture. A widening 21 at the connection aperture of the flat tube is produced by means of a forming mandrel further to enlarge the connection aperture for a better throughflow of the heating medium. The manifold 1*d*, 2*d* has as a connection aperture a bore 18 of approximately the same size as in the embodiment according to FIGS. 13 and 14. The Trough 20, pressed into the flat tube, achieves a very solid welded joint to the manifold pipe, wherein projection welding is used.

By the application of the described embodiments of the invention a heat exchanger can be manufactured which, from the points of view of manufacturing technology and overall economy, is more favorable and has the advantages derived from the application of the extremely flat pipes resulting from the high rate of flow of the heating medium and the correspondingly lower thermal inertia as well as a better heat transfer factor, all of which together contribute to a better utilization of the input energy. The mutually parallel spaced-apart, preferably vertically running flat tubes of the heat exchanger enclosing air spaces between them, have the additionally favorable effect of a rising flow of air in the manner of a chimney.

Obviously, numerous modifications and variations of the present invention are possible in light of the above teachings. It is therefore to be understood that within the scope of the appended claims, the invention may be practiced otherwise than as specifically described herein.

We claim:

1. A heat exchanger for exchanging heat with a fluid, comprising:

a plurality of flat, mutually parallel, spaced apart tubes each having a longitudinal axis, first and second end portions, first and second depressed surface portions adjacent said first and second end portions, respectively, and an expanded wall portion formed about said first and second depressed surface portions;

a plurality of collector pipes for directing said fluid to and from said heat exchanger, each of said pipes having a longitudinal axis disposed perpendicular to said longitudinal axis of each one of said tubes and having a plurality of connecting apertures formed within a wall portion of each one of said pipes;

said longitudinal axis of each of said plurality of tubes being disposed in a plane different from a plane in which said longitudinal axis of each of said collector pipes is disposed;

said first and second depressed surface portions of said tubes each defining a surface contour which corresponds to and registers with the exterior wall portion of said pipes and each having a connecting port formed in a central portion of each of said depressed surface portions; and a plurality of projection welds interconnecting each of said tubes with each of said pipes such that each said connecting port coaxially communicates with one of said plurality of connecting apertures.

2. The heat exchanger of claim 1 wherein each said connecting port of each of said tubes comprises a bore formed through a concave portion of each of said depressed surface portions of each of said tubes.

3. The heat exchanger of claim 1 wherein each of said connecting apertures comprises a bore formed through a convex portion of said pipe.

4. The heat exchanger of claim 1 wherein said connecting port is formed in a narrow curved side portion of each of said plurality of tubes.

* * * * *